United States Patent [19]

Husslein et al.

[11] 4,357,522

[45] Nov. 2, 1982

[54] BAKING OVEN

[75] Inventors: Julius Husslein, Vachendorf; Franz Röhrl, Obing; Karl Nitzinger, Traunreut; Josef Gerl, Palling, all of Fed. Rep. of Germany

[73] Assignee: Bosch-Siemens Hausgeräte GmbH, Stuttgart, Fed. Rep. of Germany

[21] Appl. No.: 217,385

[22] Filed: Dec. 17, 1980

[30] Foreign Application Priority Data

Dec. 18, 1979 [DE] Fed. Rep. of Germany ..... 2950946

[51] Int. Cl.[3] ..... F27D 11/02

[52] U.S. Cl. ..... 219/400; 99/447; 126/21 A; 219/369; 219/398; 219/413

[58] Field of Search ..... 219/369, 370, 371, 397, 219/398, 400, 408, 413, 396, 412; 126/21 A; 99/340, 447

[56] References Cited

U.S. PATENT DOCUMENTS

| | | | |
|---|---|---|---|
| 2,490,076 | 12/1949 | Maxson | 219/370 |
| 2,491,420 | 12/1949 | Scott | 219/400 |
| 3,168,642 | 2/1965 | Savio | 219/400 |
| 3,414,708 | 12/1968 | Maier | 219/400 |
| 3,678,245 | 7/1972 | Ackermann | 219/400 X |
| 3,978,843 | 9/1976 | Durth | 126/21 A |
| 4,071,738 | 1/1978 | Jenn et al. | 219/400 |

*Primary Examiner*—Volodymyr Y. Mayewsky
*Attorney, Agent, or Firm*—Herbert L. Lerner; Laurence A. Greenberg

[57] ABSTRACT

Baking oven including chamber walls defining a baking oven chamber, a door for closing off the chamber, a broiler heating element and at least one further heating element being disposed in vicinity of opposite chamber walls, and air blowing and guiding means disposed between the heating elements for generating an air stream being in the middle of the chamber and at least approximately parallel to and maintained at a given distance from the chamber walls.

14 Claims, 5 Drawing Figures

BAKING OVEN

The invention relates to a baking oven with a baking oven chamber or muffle which can be closed by a door, in which a broiler heating element is disposed, preferably near the ceiling of the chamber, and having at least one further heating element, and an air blower in conjunction with guide elements for air.

In the known air circulating baking ovens, the inner space of the baking chamber is limited by a so-called baffle wall which is provided with suction openings in the middle thereof, and has two air discharge openings or two rows of air discharge holes at the sides. An air blower is located behind the suction openings in the baffle wall, which moves the air as turbulently as possible into the baking chamber. The air is heated by an air heating element which at least partly surrounds the air blower, and the air stream is intended to flow through all regions of the baking chamber. It is accordingly disadvantageous for the swirling hot air to also flow into those regions in the baking chamber where, for example, a grease catching pan or the like is located on the floor of the chamber, which causes the development of very heavy smoke and/or gases. Particularly in so-called "hot air broilers" wherein the food to be broiled is exposed to raised cooking temperatures, extra strong smoke development results, so that the oven door would have to be opened slightly during the broiling operation, or the oven would have to be provided with an extremely effective device for drawing off the gases. In both cases, an often unacceptable deterioration of the atmosphere in the kitchen results in practically all modes of operation.

It is accordingly an object of the invention to provide a baking oven which overcomes the hereinafore-mentioned disadvantages of the heretofore-known devices of this general type, and in which in almost all modes of operation of the baking oven, the formation of strong smoke and the development of waste gases can be avoided, that the expense for controlling the temperature in the baking oven can be reduced, and that the baking oven, though of a simple, cost-saving construction, can be operated universally in an extensive range of operating modes.

With the foregoing and other objects in view there is provided, in accordance with the invention, a baking oven comprising chamber walls defining a baking oven chamber or muffle, a door for closing off the chamber, a broiler heating element preferably located near the ceiling and at least one further heating element being disposed in vicinity of opposite chamber walls (ceiling and floor, for example), and air circulating blowing and guiding means disposed between the heating elements for generating an air stream being in the middle of the chamber and at least approximately parallel to and maintained at a given distance from the chamber walls.

In accordance with another feature of the invention, there are provided food carriers preferably made of aluminum being supported within the chamber and having edges spaced from the chamber walls permitting free air flow and exchange to the generated air stream.

In accordance with a further feature of the invention, one of the chamber walls is a floor having a space free of air flow for receiving a grease or sauce pan or grease catcher.

In accordance with an added feature of the invention, there is provided a grease or sauce pan and a grease catcher covering the grease or sauce pan preferably having an opening for a ladle formed therein.

In accordance with an additional feature of the invention, one of the chamber walls is a ceiling and the broiler heating element is disposed in vicinity of the ceiling, and there is provided at least one temperature sensor of at least one temperature controller being disposed in vicinity of and thermally coupled directly or indirectly to the broiler heating element.

In this manner, a strong circulating air flow is generated in the middle of the baking chamber, where normally the food to be cooked or treated is positioned on the food carriers (pan-like trays or gratings) in one or two layers, so that the air flow directly affects the food. Here, the heated air does not get into the bottom region of the baking chamber, or does so only in a very small measure, so that burning of the greases or sauces dripping off the food (meat), and the associated strong smoke development does not occur. Therefore, in the construction of the baking oven, strict requirements are not necessary with respect to the provisions for discharging waste gases. According to the invention, even the opposite side of the baking chamber, for example the region immediately below the ceiling of the chamber, is spared the exposure to a very hot air stream. This has the advantage that the temperature sensor of the controller which regulates the operating temperature in the baking oven can be placed in this region, so that the temperature sensor is not directly influenced by the hot circulating air, and therefore can be also used for operating modes of the oven without using the circulating air. Thus, the baking oven according to the invention has the universal capability to be operated in many modes. In the middle region of the baking chamber, there is an intensive flow of hot air, i.e. the raw food is also exposed to uniform heat in different planes, a feature which is even enhanced, according to a prefered embodiment of the invention, by dimensioning the preferably aluminum food carriers in relation to the cross section of the baking chamber so that a space remains between the border edges of the food carriers and the adjacent baking chamber walls permitting a free air flow and air exchange, vertically to the main direction of the flow, as mentioned above. In this manner, air layers of different temperatures cannot be formed; such temperature differences are immediately equalized by the space which extends all around.

In accordance with yet another feature of the invention, there is provided at least one protection tube housing the at least one temperature sensor and being substantially in the plane of the broiler heating element.

In accordance with yet a further feature of the invention, there is provided at least one shielding element or baffle shielding the at least one temperature sensor and its protection tube from heat radiation emanating from the broiler heating element. The shielding may be arranged between the broiler heating element and the protection tube. In this manner, the degree of coupling can be varied; for example it can be set corresponding to the heat power of the broiler heat element. Because of the fact that the temperature sensor is in a space with practically no air flow, and is in a certain measure coupled to the broiler heating element, which preferably also forms the so-called "upper heating means" of the baking oven, the possibility exists to utilize this temperature sensor for all modes of operation of the baking oven, i.e. for conventional baking operation, for circulating air operation and for broiling operation, so that at all modes of operation approximately the same median temperature is maintained.

In accordance with yet an added feature of the invention, the at least one temperature sensor is in the form of a first temperature sensor being for a temperature controller of a pyrolytic self-cleaning operation and being disposed in one of the at least one protection tube relatively near to the broiler heating element, and a second temperature sensor preferably parallel to the first being for a temperature controller of a cooking operation and being disposed in another of the at least one protection tube relatively further from the broiler heating element.

In accordance with yet an additional feature of the invention, the one protection tube being disposed near to the broiler heating element is in the form of a shield for the other protection tube. Because of the relatively close coupling of the temperature sensor to the broiler heating element which is used as the heating element for the self-cleaning operation, only small amplitudes for regulation are necessary, thereby avoiding detrimental heat peaks, through which the enamel coating of the baking chamber could be damaged, for example.

In accordance with again another feature of the invention, there is provided a conducting element directly connecting at least one of the at least one protection tube to the broiler heating element.

In accordance with again a further feature of the invention, the conducting element is a holder frame for the broiler heating element and the at least one protection tube.

In accordance with again an added feature of the invention, there is provided a baffle wall limiting the back of the chamber and having a suction opening formed in the middle thereof, the air blowing and guiding means being in the form of an air blower disposed behind the suction openings and air guide elements, the baffle having outflow openings formed therein along side the suction opening in an asymmetrical distribution pattern forming the air guide elements, the outflow openings closest to the at least one temperature sensor being farther from the ceiling than the outflow openings furthest from the at least one temperature sensor. In this manner, circulating air is prevented from coming directly in contact with the temperature sensors, and with their protection tubes.

Corresponding to universal usage possibilities, in accordance with again an additional feature of the invention, the blowing and guiding means includes an unheated air blower, and there is provided a switching circuit for the heating elements being operable in a first switching position for operating the heating elements separately as upper and lower heating means, in a second switching position for operating the heating elements in series as upper and lower heating means and selectively operating the air blower, and in a third switching position for alternatingly operating the broiler heating element and the air blower in predetermined time intervals.

In accordance with a concomitant feature of the invention, at least one of the heating elements includes a multiplicity of heating resistors being separately includable in the circuit and operable in series. Especially when using the last-mentioned so-called grilling mode, outstanding broiling or grilling results can be achieved, whereby the food is uniformly and thoroughly cooked by the alternatingly circulating air, and by the subsequently automatic activation of the broiler heater, the food receives the brown coloration typical for broiled food. A special advantage is therefore that the median temperature in the baking oven and the temperature at the surface of the food is considerably lower than in the conventional broiling methods, so that, for example, meat which is being broiled spatters very little or not at all, thus avoiding grease collecting at the baking oven walls. Naturally, the possibility exists here to adjust and vary the on/off ratio of the circulating air and the broiler heating element with respect to the food in the oven. Because of the relatively low cooking temperature less smoke and waste gases are also generated, so that broiling can be done with the baking oven door closed in all cases. During the self-cleaning operation, the hot broiler heating element used for this purpose serves simultaneously as an after-burner, at which the combustion gases are burned and thereby "cleaned".

Other features which are considered as characteristic for the invention are set forth in the appended claims.

Although the invention is illustrated and described herein as embodied in a baking oven, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
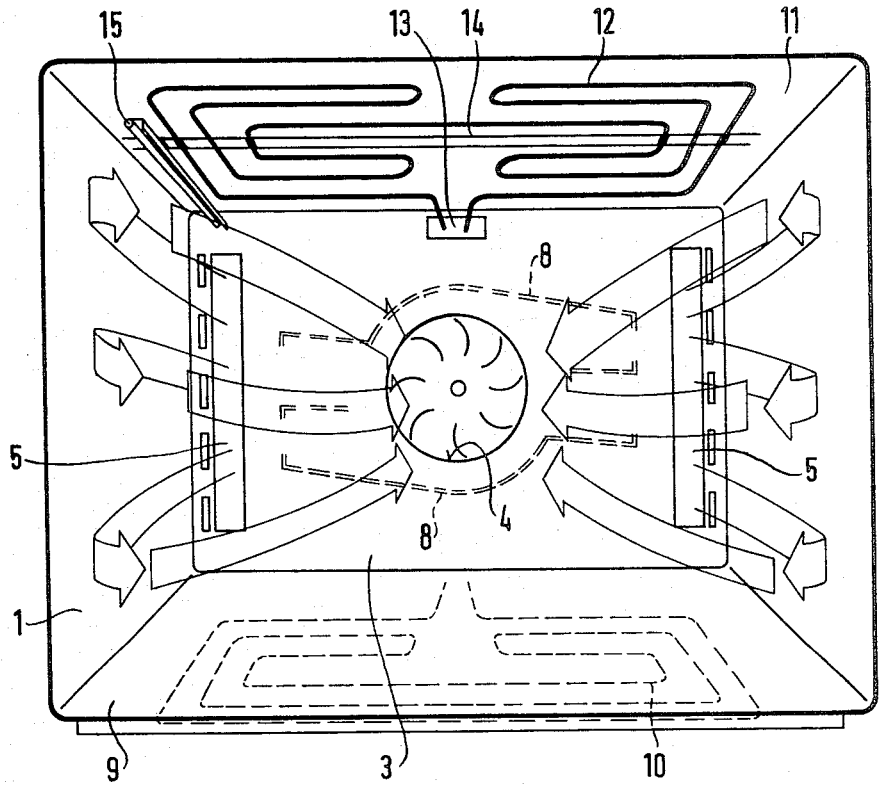
FIG. 1 is a diagrammatic perspective view of the baking oven according to the invention as seen from the front.
Figure 2:
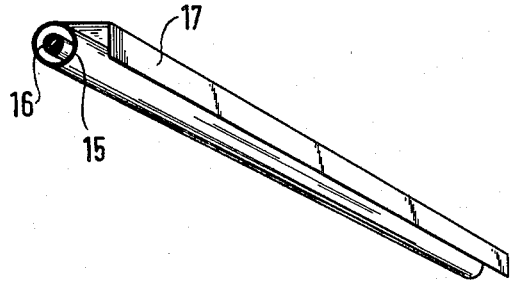
FIG. 2 is an enlarged diagrammatic perspective view of part of the baking oven according to FIG. 1.
Figure 4:
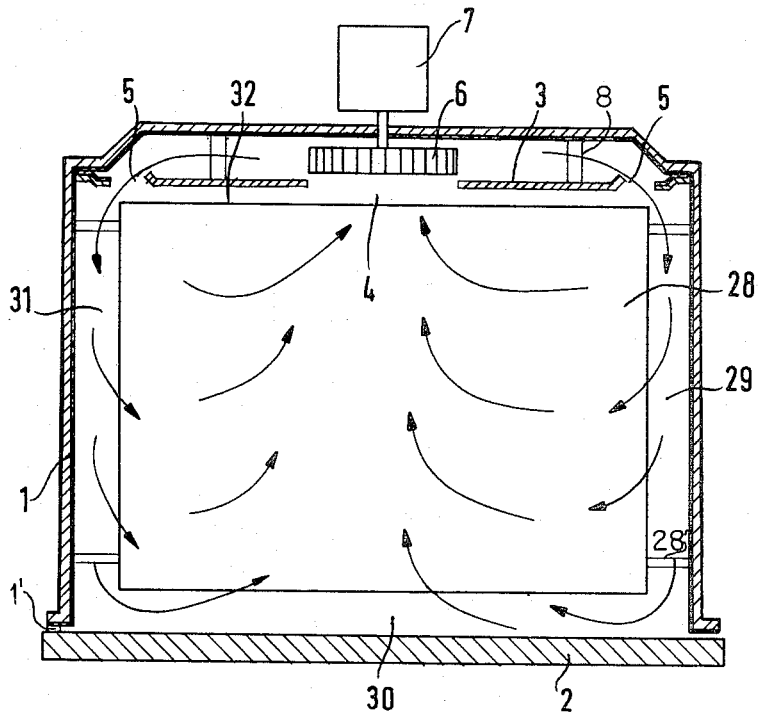
FIGS. 4 and 5 are a top plan view and a fragmentary cross-sectional view of the baking oven according to the invention shown in FIGS. 1 and 3, respectively.
Figure 5:
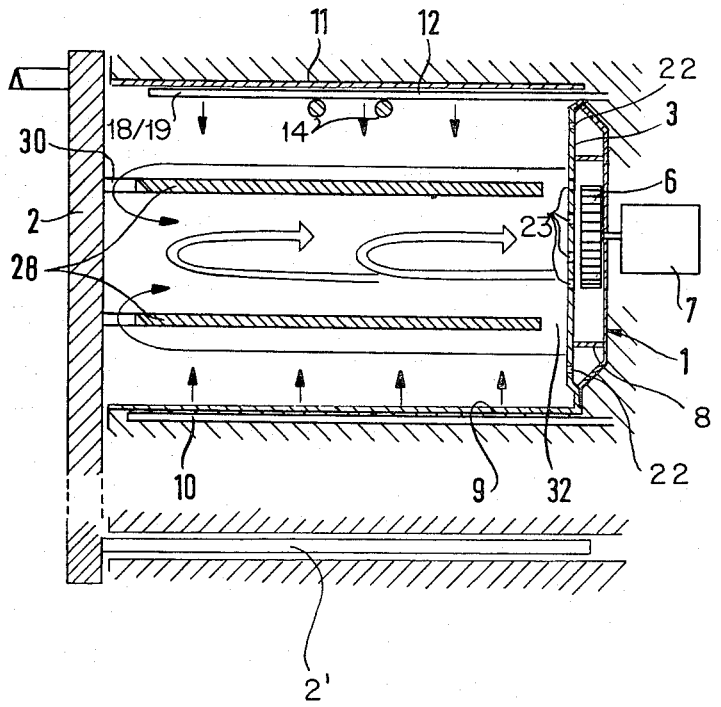

Referring now to the figures of the drawing and first, particularly, to the embodiment according to FIGS. 1, 2, 4 and 5, there is seen a square-shaped baking oven chamber or muffle 1, having a front-side opening that can be closed tightly, such as by a hinged door 2. This door is not shown in FIG. 1 but is seen in FIG. 4 with a hinge 1', and a door with a slide 2' is shown in FIG. 5. As is conventional, this baking oven chamber is surrounded by a heat insulating layer. As shown in FIGS. 1 and 4, the interior space of the muffle i.e. the baking chamber, is limited by a so-called baffle wall 3 in the back. The wall 3 is provided with a suction opening 4 formed approximately in the middle of the baffle wall, and has slot-like outflow openings 5 at both sides of the suction opening 4. Behind the suction opening 4, a recirculating blower 6 that can be driven by a drive motor 7 is disposed, as seen in FIG. 4.

As shown in FIG. 1, the air blower 6 is surrounded by guide baffles 8 for the air flow, which assure a flow from behind the baffle-wall 3 from the air blower 6 in the direction toward the outflow openings 5. Below the bottom 9 of the baking oven chamber, an external heating element 10 which is the so-called lower heating means, is disposed. In the immediate vicinity of the ceiling 11 of the baking chamber, an interior heating element 12 for grilling or broiling is disposed. The heating element 12 is in contact with a plug 13, for example, or another type of connecting element through its electrical terminals. As is especially clearly shown in FIG. 1, the heating element 12 for broiling is supported by a bracket-like holding frame 14, which itself is fastened at the upper edges of the side walls of the baking chamber. In the embodiment according to FIG. 1, the holding frame 14 also carries a protection tube 15 for a temperature sensor 16 of a temperature-dependent control element which is not further described. The control element regulates a preset operating temperature in the baking oven in a known manner. This construction is shown in detail in FIG. 2, wherein it is seen that the protector tube 15 is connected with an L-shaped shielding-element 17. Because of this shielding element 17, the protective tube 15, and therefore the elongated temperature sensor which lies in the plane of the broiler heating element 12 and parallel to side sections of the heating element, is shielded from the direct heat radiation of the broiler heat element when in operation. However, the protective tube 15 is in a heat conducting connection with the broiler heating element 12 through the holder frame 14.

Figure 3:
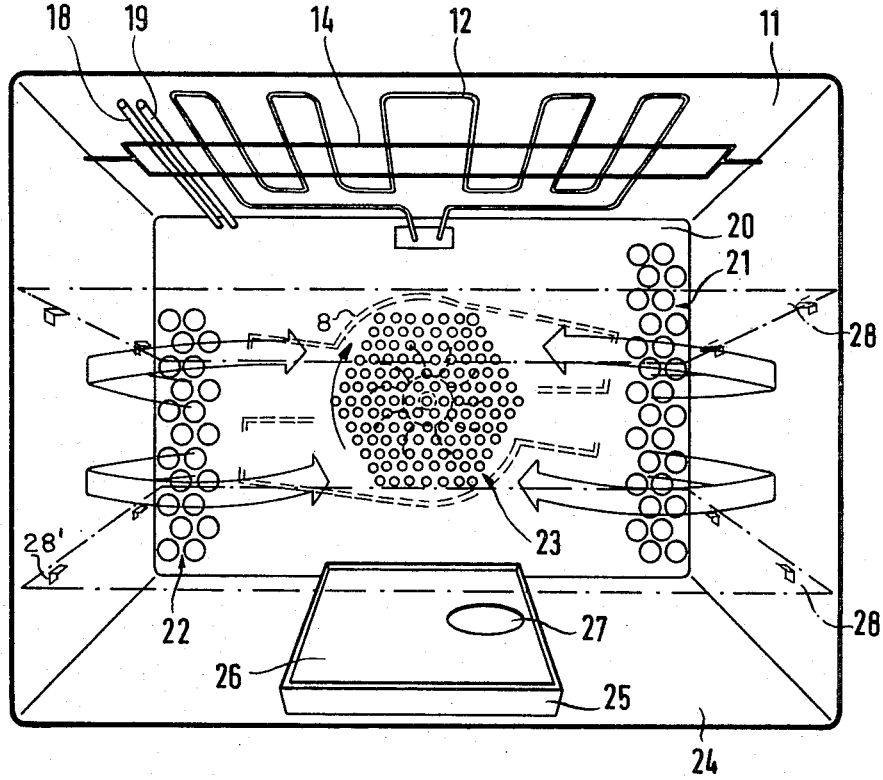
FIG. 3 is a view similar to FIG. 1 of a representation of the baking oven according to the invention in a slightly altered construction.

In the embodiment according to FIG. 3, instead of one protective tube 15 according to FIG. 1, there are two protection tubes 18, 19 in the immediate vicinity to the broiler heating element 12 that are fastened at the holding frame 14 and are parallel to each other. These tubes also extend through the baffle wall 20 and through the back wall of the baking chamber, respectively, and are provided for receiving the elongated temperature sensors. The temperature sensors are connected with two preferably multi-channel, temperature controllers. In this way the temperature sensor in the protection tube 19 with its controller serves to regualte the pyrolytic self-cleaning temperature of approximately 500° C. in the baking oven, while the temperature sensor in the protection tube 18 which is disposed toward the side wall and its controller serve for regulating the normal baking temperature in the baking oven. The protection tube 19 of the self-cleaning controller thereby acts as shielding means for the protection tube 18 of the baking oven controller, comparable to the shielding element 17 according to FIG. 1. Therefore in this embodiment as well the protection tube 18 is not exposed to the full heat radiation of the broiler heating element 12. Furthermore, in the embodiment according to FIG. 3, a pattern of holes are provided as outflow openings 21 and 22 immediately adjacent to the chamber wall, whereby the hole-pattern distribution at both sides of a suction opening 23, which is also a pattern of holes, is not symmetrical. That is to say that the hole pattern 22 below the protection tubes 18 and 19 is at a greater distance from the ceiling 11 of the baking chamber than hole pattern 21 near the opposite side wall where no temperature sensor is located. As is also shown in FIG. 3, a grease or sauce pan 25 is placed at the bottom 24 of the chamber, or a grease catcher or the like may be used, in which the fat which drops down from meat during broiling or roasting is collected. In the embodiment, the grease or sauce pan 25 is almost completely covered by splash-guard 26, and has only an opening 27 for a ladle.

As is indicated in FIGS. 3, 4 and 5, two food carriers 28 are supported and spaced apart in the interior of the oven in two planes on top of each other on holding elements 28'. One carrier 28 blocks the view of the other in FIG. 4. These pan or grill-like food carriers, preferably made of aluminum, are so dimensioned in relation to the chamber cross-section shown in FIG. 4 that the space 29 to 32 is maintained between the border edges of the food carrier and the adjacent chamber walls; i.e. the circumferential edges of the food carrier are recessed from the chamber walls, including the inner side of the baking oven door 2, and spaced away from them.

The baking oven has switching means which are not further shown in the figures for both heating elements 10 and 12, and also for the air-blower and for its drive motor 7, respectively. In a first switching position of the switching means, for example for defrosting tarts, only the air blower 6 can be operated. In a second switching position, which, for example, is associated with a temperature of from 50° to 250° C., the lower heating means 10, and in series therewith the broiler heating element 12, is switched on, such as for baking or roasting a quantity of food. The air blower can thereby be additionally switched on at any time. In a third switching position, for example in the 50° to 250° range as well, the blower 6, the lower heating means 10, and the broiler heating element also in series therewith are switched on. In a fourth switching position, for example for grilling steaks, only the broiler heating element 12 if operated, while in a fifth switching position, alternatingly in cycled sequence, the air blower 6 and the broiler heating element 12 are switched on sequentially in a chosen duty cycle in rhythmic ratio. Finally, a sixth switching position may be provided for "Automatic Roasting", whereby the lower heating means 10 and the broiler heating element 12 are switched on in sequence. For this purpose, a special switch may be provided. All modes of operation are carried out with the baking oven door 2 closed. The air guiding elements 8, 5, 21 and 22, according to the herein-described embodiments, are so disposed and adjusted that in the middle region of the baking chamber an air flow is created, at least approximately parallel to the bottom 9, 24 of the chamber and to the chamber ceiling 11 which is kept at a distance from the chamber bottom and ceiling. This is clarified in the figures by arrows indicating the flow. It can be especially clearly seen from FIGS. 3 and 5, that the strongest airflow occurs between the two food carriers 28, while above and below the food carriers 28, only a weak flow or no air flow at all is effected. As especially made clear by FIG. 5, the air flow in the middle causes a uniform heating of the food disposed in the two levels, or planes, by uniform heating of the upper food carrier, and by direct contact with the food on the lower carrier. In contrast, the two other sides of the food are directly (on top) and indirectly (on the bottom) exposed to the heat radiation of the broiler heating element 12, and the lower heating means 10, whereby in the herein-described baking oven, the broiler heating element 12 represents the so-called upper heating means. Through the special asymmetrical distribution of the outflow openings according to FIG. 3, the air flow is kept away from the temperature sensors and from their protection tubes 18, 19, respectively, so that no direct influence exists in this respect. In a similar manner, the air flow is kept away, or at least the greater part of it is kept away, from the bottom of the chamber, so that grease collected there does not get heated which can develop a great deal of smoke. By the presence of the spacing 29 to 32, an uninhibited air and heat exchange in the middle region of the chamber becomes possible, so that in this region a uniform operating temperature is generated.

There is claimed:

1. Baking oven comprising a chamber ceiling, bottom and walls defining a baking oven chamber, a door for closing off said chamber, at least one broiler heating element disposed in vicinity of said chamber ceiling, recirculating air blowing means being selectively operable independently and in an alternating sequence with said broiler heating element at preset cyclical intervals, air guiding means operating in conjunction with said air blowing means for generating air flow and defining a space being substantially free of air flow in the vicinity of said chamber bottom, and a temperature regulating and controlling sensor disposed in vicinity of and coupled to said broiler heating element for preventing intense smoke development during said independent and said alternating sequence operation of said blowing means and broiler heating element.

2. Baking oven according to claim 1, including food carriers being supported within said chamber and having edges spaced from said chamber walls permitting free air flow and exchange to said generated air flow.

3. Baking oven according to claim 1, including at least one further heating element disposed in vicinity of said chamber bottom.

4. Baking oven according to claim 1, including a grease or sauce pan disposed in said space, and a grease catcher covering said grease or sauce pan.

5. Baking oven according to claim 1, wherein said temperature sensor is thermally coupled to said broiler heating element.

6. Baking oven according to claim 1, including at least one protection tube, housing said temperature sensor and being substantially in the plane of said broiler heating element.

7. Baking oven according to claim 1 or 6, including at least one shielding element shielding said temperature sensor from heat radiation emanating from said broiler heating element.

8. Baking oven according to claim 7, wherein said temperature sensor is in the form of a first temperature sensor being for a temperature controller of a pyrolytic self-cleaning operation and being disposed in one of said at least one protection tube relatively near to said broiler heating element, and a second temperature sensor being for a temperature controller of a cooking operation and being disposed in another of said at least one protection tube relatively further from said broiler heating element.

9. Baking oven according to claim 8, wherein said one protection tube being disposed near to said broiler heating element is in the form of a shield for said other protection tube.

10. Baking oven according to claim 6, including a conducting element directly connecting at least one of said at least one protection tube to said broiler heating element.

11. Baking oven according to claim 10, wherein said conducting element is a holder frame for said broiler heating element and said at least one protection tube.

12. Baking oven according to claim 1, including a baffle wall limiting the back of said chamber and having a suction opening formed in the middle thereof, said air blowing and guiding means being in the form of an air blower disposed behind said suction openings and air guide elements, said baffle having outflow openings formed therein along side said suction openings in an asymmetrical distribution pattern forming said air guide elements, said outflow openings closest to said temperature sensor being farther from said ceiling than said outflow openings furthest from said at least one temperature sensor.

13. Baking oven according to claim 3, wherein said blowing and guiding means includes an unheated air blower, and including a switching circuit for said heating elements being operable in a first switching position for operating said heating elements separately as upper and lower heating means, in a second switching position for operating said heating elements in series as upper and lower heating means and selectively operating said air blower, and in a third switching position for said alternating sequence operation of said broiler heating element and said air blower in predetermined time intervals.

14. Baking oven according to claim 1, wherein at least one of said heating elements includes a multiplicity of heating resistors being separately operable in series.

* * * * *